US006446722B2

(12) United States Patent
Nguyen et al.

(10) Patent No.: US 6,446,722 B2
(45) **Date of Patent: *Sep. 10, 2002**

(54) METHODS FOR COMPLETING WELLS IN UNCONSOLIDATED SUBTERRANEAN ZONES

(75) Inventors: Philip D. Nguyen, Frisco; Ronald G. Dusterhoft, Katy, both of TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/361,714

(22) Filed: Jul. 27, 1999

Related U.S. Application Data

(63) Continuation-in-part of application No. 09/084,906, filed on May 26, 1998, now Pat. No. 5,934,376, which is a continuation-in-part of application No. 08/951,936, filed on Oct. 16, 1997, now Pat. No. 6,003,600.

(51) Int. Cl.[7] ..... E21B 33/13
(52) U.S. Cl. ..... 166/278; 166/281; 166/236
(58) Field of Search ..... 166/278, 276, 166/51, 281, 227, 236

(56) References Cited

U.S. PATENT DOCUMENTS

| | | | | |
|---|---|---|---|---|
| 1,305,915 A | | 6/1919 | Mack | |
| 1,341,755 A | | 6/1920 | Minton | |
| 2,342,913 A | | 2/1944 | Williams et al. | |
| 2,344,909 A | | 3/1944 | Williams et al. | |
| 4,102,395 A | | 7/1978 | Robinson | 166/231 |
| 5,560,427 A | * | 10/1996 | Jones et al. | 166/280 |
| 5,934,376 A | * | 8/1999 | Nguyen et al. | 166/278 |
| 6,003,600 A | * | 12/1999 | Nguyen et al. | 166/281 |

* cited by examiner

*Primary Examiner*—David Bagnell
*Assistant Examiner*—John Kreck
(74) *Attorney, Agent, or Firm*—Paul I. Herman; Michael W. Piper

(57) ABSTRACT

Improved methods and apparatus for completing an unconsolidated subterranean zone penetrated by a well bore are provided. The methods basically comprise the steps of placing a slotted liner having an internal sand screen disposed therein in the zone, isolating the slotted liner and the well bore in the zone and injecting particulate material into the annuli between the sand screen and the slotted liner and the slotted liner and the well bore to thereby form packs of particulate material therein to prevent the migration of fines and sand with produced fluids.

47 Claims, 5 Drawing Sheets

METHODS FOR COMPLETING WELLS IN UNCONSOLIDATED SUBTERRANEAN ZONES

RELATED APPLICATION DATA

This application is a continuation-in-part of application Ser. No. 09/084,906 now U.S. Pat. No. 5,934,376 filed on May 26, 1998 which is a continuation-in-part of application Ser. No. 08/951,936 now U.S. Pat. No. 6,003,600 filed on Oct. 16, 1997.

BACKGROUND OF THE INVENTION

1. Field of the Invention

The present invention relates to improved methods and apparatus for completing wells in unconsolidated subterranean zones, and more particularly, to improved methods and apparatus for completing such wells whereby the migration of fines and sand with the fluids produced therefrom is prevented.

2. Description of the Prior Art

Oil and gas wells are often completed in unconsolidated formations containing loose and incompetent fines and sand which migrate with fluids produced by the wells. The presence of formation fines and sand in the produced fluids is disadvantageous and undesirable in that the particles abrade pumping and other producing equipment and reduce the fluid production capabilities of the producing zones in the wells.

Heretofore, unconsolidated subterranean zones have been stimulated by creating fractures in the zones and depositing particulate proppant material in the fractures to maintain them in open positions. In addition, the proppant has heretofore been consolidated within the fractures into hard permeable masses to reduce the migration of formation fines and sands through the fractures with produced fluids. Further, gravel packs which include sand screens and the like have commonly been installed in the well bores penetrating unconsolidated zones. The gravel packs serve as filters and help to assure that fines and sand do not migrate with produced fluids into the well bores.

In a typical gravel pack completion, a screen is placed in the well bore and positioned within the unconsolidated subterranean zone which is to be completed. The screen is typically connected to a tool which includes a production packer and a cross-over, and the tool is in turn connected to a work or production string. A particulate material which is usually graded sand, often referred to in the art as gravel, is pumped in a slurry down the work or production string and through the cross over whereby it flows into the annulus between the screen and the well bore. The liquid forming the slurry leaks off into the subterranean zone and/or through the screen which is sized to prevent the sand in the slurry from flowing therethrough. As a result, the sand is deposited in the annulus around the screen whereby it forms a gravel pack. The size of the sand in the gravel pack is selected such that it prevents formation fines and sand from flowing into the well bore with produced fluids.

A problem which is often encountered in forming gravel packs, particularly gravel packs in long and/or deviated unconsolidated producing intervals, is the formation of sand bridges in the annulus. That is, non-uniform sand packing of the annulus between the screen and the well bore often occurs as a result of the loss of carrier liquid from the sand slurry into high permeability portions of the subterranean zone which in turn causes the formation of sand bridges in the annulus before all the sand has been placed. The sand bridges block further flow of the slurry through the annulus which leaves voids in the annulus. When the well is placed on production, the flow of produced fluids is concentrated through the voids in the gravel pack which soon causes the screen to be eroded and the migration of fines and sand with the produced fluids to result.

In attempts to prevent the formation of sand bridges in gravel pack completions, special screens having internal shunt tubes have been developed and used. While such screens have achieved varying degrees of success in avoiding sand bridges, they, along with the gravel packing procedure, are very costly.

Thus, there are needs for improved methods and apparatus for completing wells in unconsolidated subterranean zones whereby the migration of formation fines and sand with produced fluids can be economically and permanently prevented while allowing the efficient production of hydrocarbons from the unconsolidated producing zone.

SUMMARY OF THE INVENTION

The present invention provides improved methods and apparatus for completing wells, and optionally simultaneously fracture stimulating the wells, in unconsolidated subterranean zones which meet the needs described above and overcome the deficiencies of the prior art. The improved methods basically comprise the steps of placing a slotted liner having an internal sand screen disposed therein whereby an annulus is formed between the sand screen and the slotted liner in an unconsolidated subterranean zone, isolating the annulus between the slotted liner and the well bore in the zone, injecting particulate material into the annulus between either or both the sand screen and the slotted liner and the liner and the zone by way of the slotted liner whereby the particulate material is uniformly packed into the annuli between the sand screen and the slotted liner and between the slotted liner and the zone. The permeable pack of particulate material formed prevents the migration of formation fines and sand with fluids produced into the well bore from the unconsolidated zone.

As mentioned, the unconsolidated formation can be fractured prior to or during the injection of the particulate material into the unconsolidated producing zone, and the particulate material can be deposited in the fractures as well as in the annuli between the sand screen and the slotted liner and between the slotted liner and the well bore.

The apparatus of this invention are basically comprised of a slotted liner having an internal sand screen disposed therein whereby an annulus is formed between the sand screen and the slotted liner, a cross-over adapted to be connected to a production string attached to the slotted liner and sand screen and a production packer attached to the cross-over.

The improved methods and apparatus of this invention avoid the formation of sand bridges in the annulus between the slotted liner and the well bore thereby producing a very effective sand screen for preventing the migration of fines and sand with produced fluids.

It is, therefore, a general object of the present invention to provide improved methods of completing wells in unconsolidated subterranean zones.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

The present invention provides improved methods of completing, and optionally simultaneously fracture stimulating, an unconsolidated subterranean zone penetrated by a well bore. The methods can be performed in either vertical or horizontal well bores which are open-hole or have casing cemented therein. The term "vertical well bore" is used herein to mean the portion of a well bore in an unconsolidated subterranean producing zone to be completed which is substantially vertical or deviated from vertical in an amount up to about 15°. The term "horizontal well bore" is used herein to mean the portion of a well bore in an unconsolidated subterranean producing zone to be completed which is substantially horizontal or at an angle from vertical in the range of from about 15° to about 75°.

Figure 1:
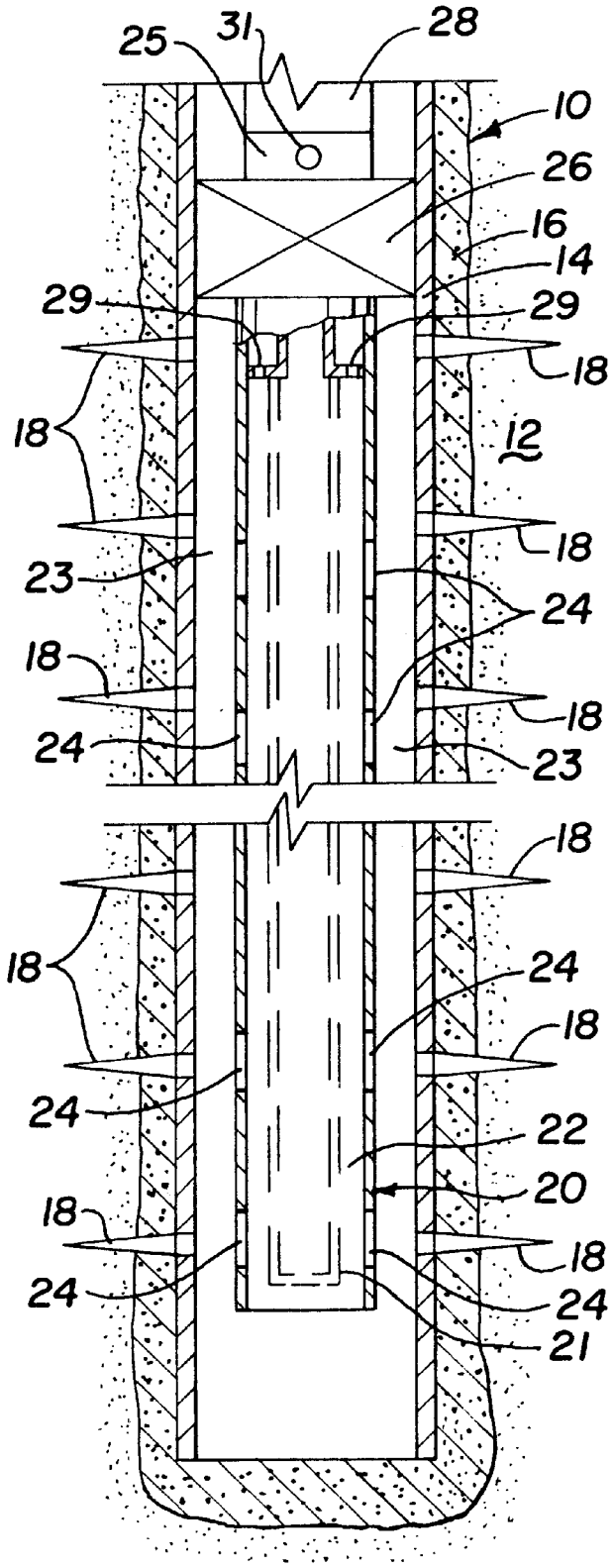
FIG. 1 is a side-cross sectional view of a well bore penetrating an unconsolidated subterranean producing zone having casing cemented therein and having a slotted liner with an internal sand screen, a production packer and a cross-over connected to a production string disposed therein.
Figure 2:
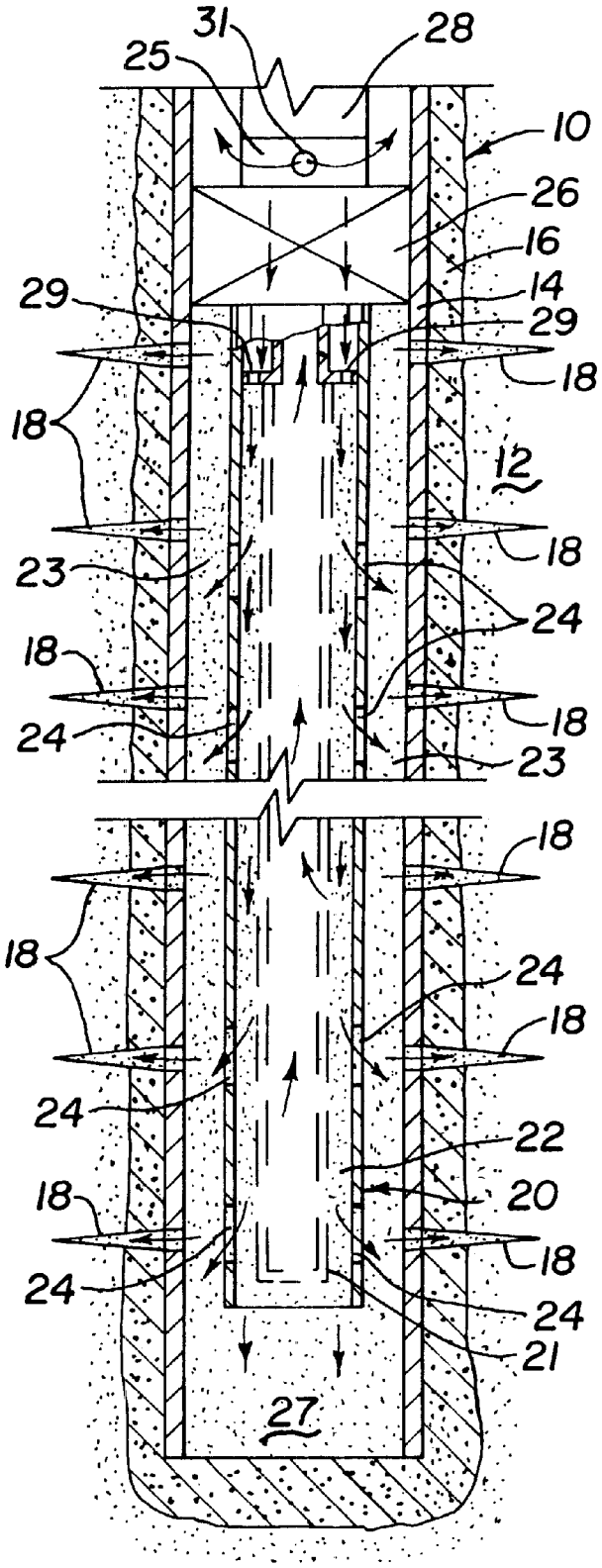
FIG. 2 is a side cross sectional view of the well bore of FIG. 1 after particulate material has been packed therein.
Figure 3:
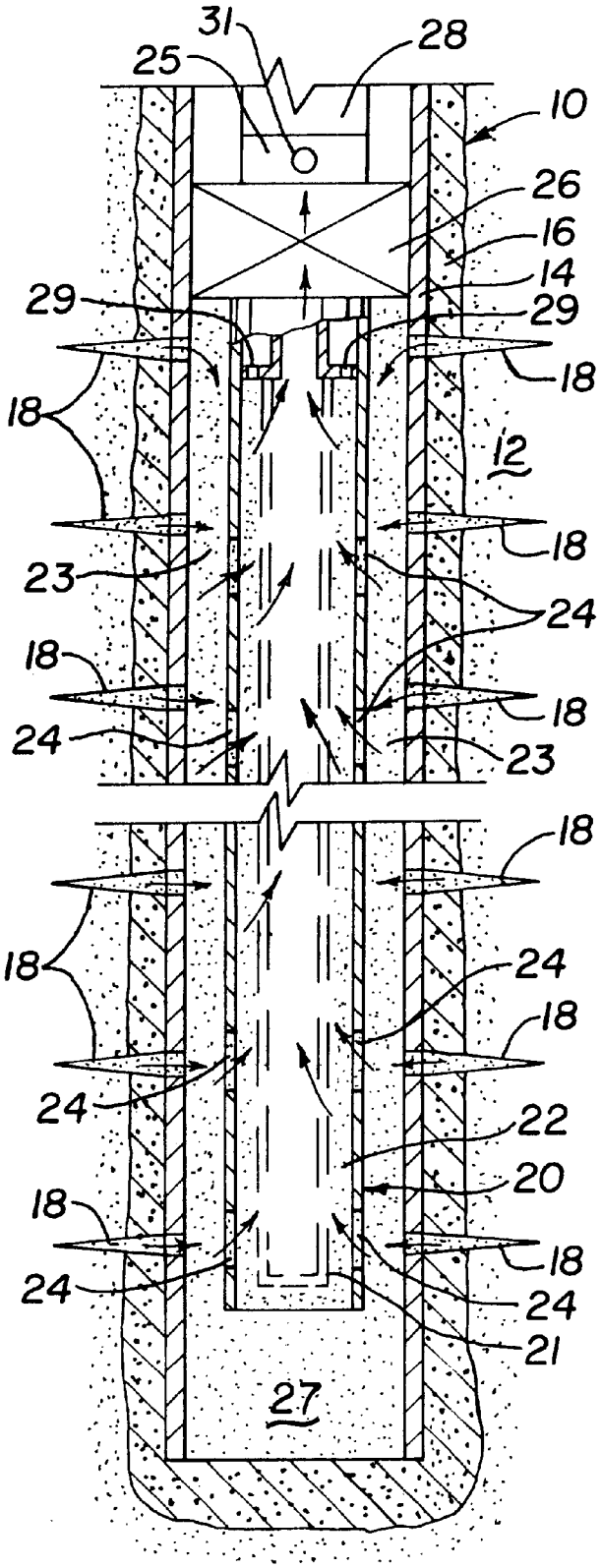
FIG. 3 is a side cross sectional view of the well bore of FIG. 1 after the well has been placed on production.

Referring now to the drawings and particularly to FIGS. 1–3, a vertical well bore 10 having casing 14 cemented therein is illustrated extending into an unconsolidated subterranean zone 12. The casing 14 is bonded within the well bore 10 by a cement sheath 16. A plurality of spaced perforations 18 produced in the well bore 10 utilizing conventional perforating gun apparatus extend through the casing 14 and cement sheath 16 into the unconsolidated producing zone 12.

Figure 6:
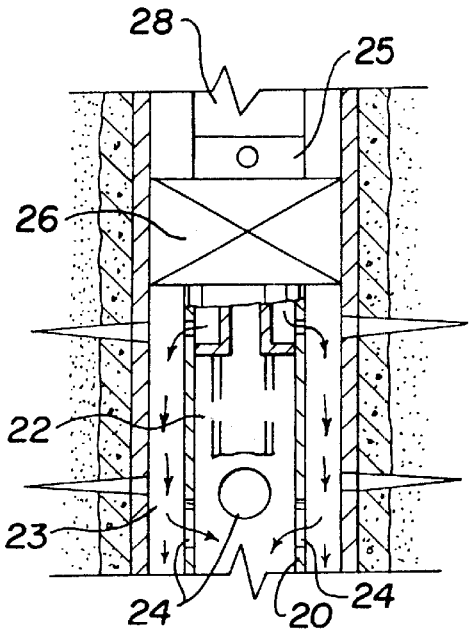
FIG. 6 is a side cross-sectional view of the well bore of FIG. 1.
Figure 7:
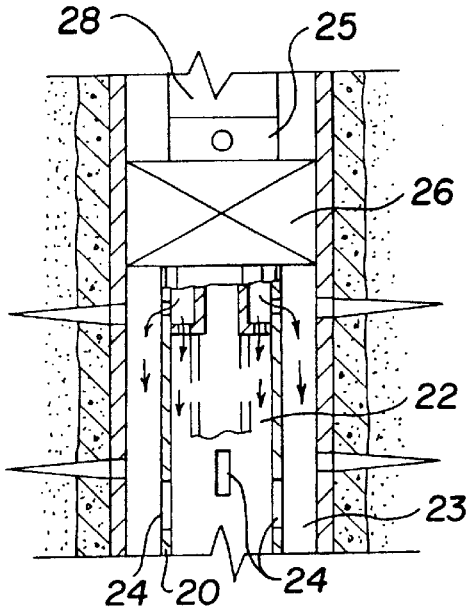
FIG. 7 is a side cross-sectional view of the well bore of FIG. 1.

In accordance with the methods of the present invention a slotted liner 20 having an internal sand screen 21 installed therein whereby an annulus 22 is formed between the sand screen 21 and the slotted liner 20 is placed in the well bore 10. The slotted liner 20 and sand screen 21 have lengths such that they substantially span the length of the producing interval in the well bore 10. The slotted liner 20 is of a diameter such that when it is disposed within the well bore 10 an annulus 23 is formed between it and the casing 14. The slots 24 in the slotted liner 20 can be circular as illustrated in the drawings (see cutaway portion within FIG. 6 illustrating individual slot 24 on back surface of slotted liner 20), or they can be rectangular (see cutaway portion within FIG. 7 illustrating individual slot 24 on back surface of slotted liner 20) or other shape. Generally, when circular slots are utilized they are at least ½" in diameter, and when rectangular slots are utilized they are at least ⅜" wide by 2" long.

As shown in FIGS. 1–3, the slotted liner 20 and sand screen 21 are connected to a cross-over 25 which is in turn connected to a production string 28. A production packer 26 is attached to the cross-over 25. The cross-over 25 and production packer 26 are conventional gravel pack forming tools and are well known to those skilled in the art. The cross-over 25 is a sub-assembly which allows fluids to follow a first flow pattern whereby particulate material suspended in a slurry can be packed in the annuli between the sand screen 21 and the slotted liner 20 and between the slotted liner 20 and the well bore 10. That is, as shown by the arrows in FIG. 2, the particulate material suspension flows from inside the production string 28 to the annulus 22 between the sand screen 21 and slotted liner 20 by way of two or more ports 29 in the cross-over 25. Simultaneously, fluid is allowed to flow from inside the sand screen 21 upwardly through the cross-over 25 to the other side of the packer 26 outside of the production string 28 by way of one or more ports 31 in the cross-over 25. By pipe movement or other procedure, flow through the cross-over 25 can be selectively changed to a second flow pattern (shown in FIG. 3) whereby fluid from inside the sand screen 20 flows directly into the production string 28 and the ports 31 are shut off. The production packer 26 is set by pipe movement or other procedure whereby the annulus 23 is sealed.

After the slotted liner 20 and sand screen 21 are placed in the well bore 10, the annulus 23 between the slotted liner 20 and the casing 14 is isolated by setting the packer 26 in the casing 14 as shown in FIG. 1. Thereafter, as shown in FIG. 2, a slurry of particulate material 27 is injected into the annulus 22 between the sand screen 21 and the slotted liner 20 by way of the ports 29 in the cross-over 25 and into the annulus 23 between the slotted liner 20 and the casing 14 by way of the slots 24 in the slotted liner 20. The particulate material flows into the perforations 18 and fills the interior of the casing 14 below the packer 26 except for the interior of the sand screen 21. That is, as shown in FIG. 2, a carrier liquid slurry of the particulate material 27 is pumped from the surface through the production string 28 and through the cross-over 25 into annulus 22 between the sand screen 21 and the slotted liner 20. From the annulus 22, the slurry flows through the slots 24 and through the open end of the slotted liner 20 into the annulus 23 and into the perforations 18. The carrier liquid in the slurry leaks off through the perforations 18 into the unconsolidated zone 12 and through the screen 21 from where it flows through cross-over 25 and into the casing 14 above the packer 26 by way of the ports 31. This causes the particulate material 27 to be uniformly packed in the perforations 18, in the annulus 23 between the slotted liner 20 and the casing 14 and within the annulus 22 between the sand screen 21 and the interior of the slotted liner 20.

Alternatively, the upper end of slotted liner 20 may be open below packer 26 to receive a flow of the slurry from production string 28 such that the slurry flows into both annulus 22 and 23 substantially simultaneously from cross-over 25 (see, e.g. FIG. 7) or the slurry may flow into just annulus 23 (see, e.g. FIG. 6) and then by way of the slots 24 into annulus 22 to pack as described above.

After the particulate material has been packed into the well bore 10 as described above, the well is returned to production as shown in FIG. 3. The pack of particulate material 27 formed filters out and prevents the migration of formation fines and sand with fluids produced into the well bore from the unconsolidated subterranean zone 12.

Figure 4:
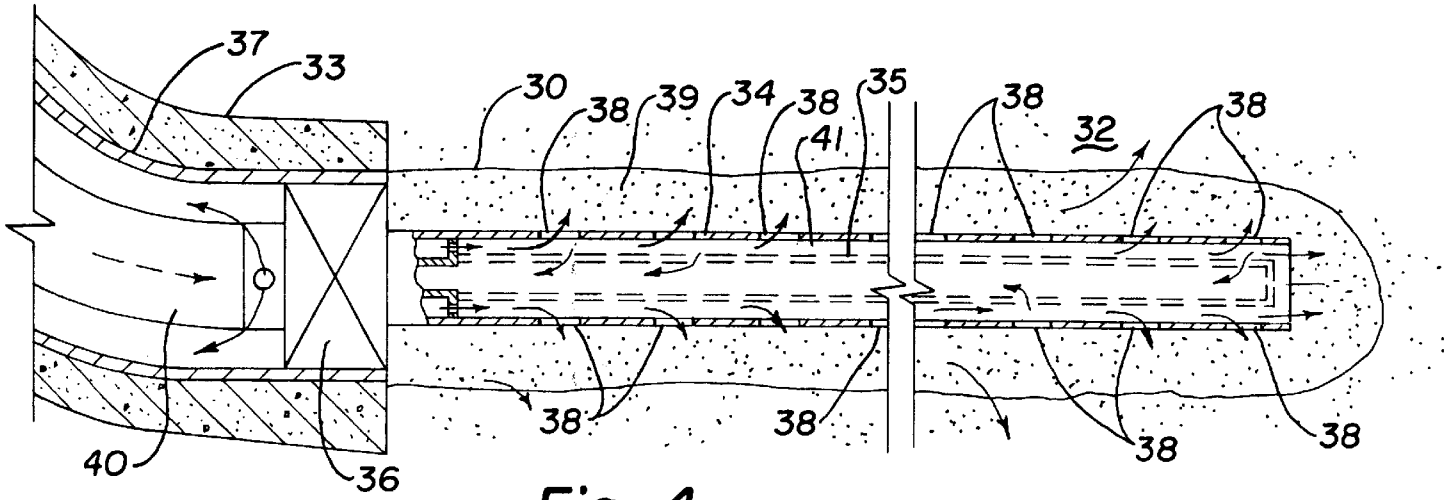
FIG. 4 is a side cross sectional view of a horizontal open-hole well bore penetrating an unconsolidated subterranean producing zone having a slotted liner with an internal sand screen, a production packer and a cross-over connected to a production string disposed therein.
Figure 5:
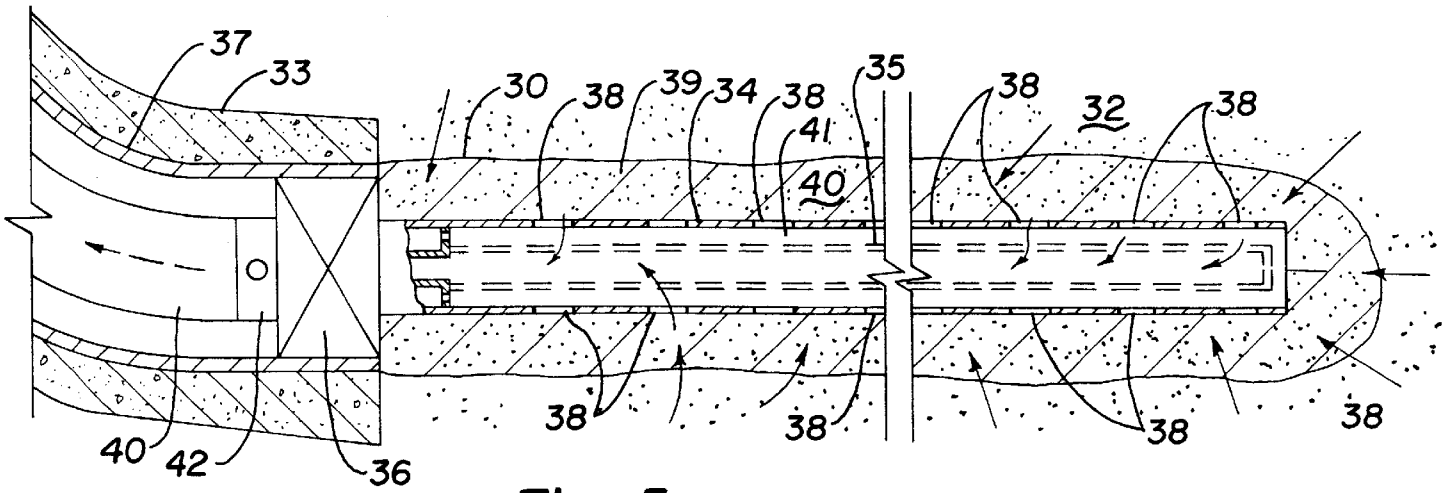
FIG. 5 is a side cross sectional view of the horizontal open hole well bore of FIG. 4 after particulate material has been packed therein.

Referring now to FIGS. 4 and 5, a horizontal open-hole well bore 30 is illustrated. The well bore 30 extends into an unconsolidated subterranean zone 32 from a cased and cemented well bore 33 which extends to the surface. As described above in connection with the well bore 10, a slotted liner 34 having an internal sand screen 35 disposed therein whereby an annulus 41 is formed therebetween is placed in the well bore 30. The slotted liner 34 and sand screen 35 are connected to a cross-over 42 which is in turn connected to a production string 40. A production packer 36 is connected to the cross-over 42 which is set within the casing 37 in the well bore 33.

In carrying out the methods of the present invention for completing the unconsolidated subterranean zone 32 penetrated by the well bore 30, the slotted liner 34 with the sand screen 35 therein is placed in the well bore 30 as shown in FIG. 4. The annulus 39 between the slotted liner 34 and the well bore 30 is isolated by setting the packer 36. Thereafter, a slurry of particulate material is injected into the annulus 41 between the sand screen 35 and the slotted liner 34 and by way of the slots 38 into the annulus 39 between the slotted liner 34 and the well bore 30. Because the particulate material slurry is free to flow through the slots 38 as well as the open end of the slotted liner 34, the particulate material is uniformly packed into the annulus 39 between the well bore 30 and slotted liner 34 and into the annulus 41 between the screen 35 and the slotted liner 34. The pack of particulate material 40 formed filters out and prevents the migration of formation fines and sand with fluids produced into the well bore 30 from the subterranean zone 32.

Alternatively, the upper end of slotted liner 34 near packer 36 may be open to receive a flow of the slurry from production string 40. In this instance, the slurry passing through cross-over 42 may flow into both annulus 39 and 41 substantially simultaneously or into just annulus 39 and then by way of slots 38 and the lower open end of slotted liner 34 into annulus 41 to thereby avoid bridging.

The methods and apparatus of this invention are particularly suitable and beneficial in forming gravel packs in long-interval horizontal well bores without the formation of sand bridges. Because elaborate and expensive sand screens including shunts and the like are not required and the pack sand does not require consolidation by a hardenable resin composition, the methods of this invention are very economical as compared to prior art methods.

The particulate material utilized in accordance with the present invention is preferably graded sand which is sized based on a knowledge of the size of the formation fines and sand in the unconsolidated zone to prevent the formation fines and sand from passing through the gravel pack, i.e., the formed permeable sand pack 27 or 40. The graded sand generally has a particle size in the range of from about 10 to about 70 mesh, U.S. Sieve Series. Preferred sand particle size distribution ranges are one or more of 10–20 mesh, 20–40 mesh, 40–60 mesh or 50–70 mesh, depending on the particle size and distribution of the formation fines and sand to be screened out by the graded sand.

The particulate material carrier liquid utilized, which can also be used to fracture the unconsolidated subterranean zone if desired, can be any of the various viscous carrier liquids or fracturing fluids utilized heretofore including gelled water, oil base liquids, foams or emulsions. The foams utilized have generally been comprised of water based liquids containing one or more foaming agents foamed with a gas such as nitrogen. The emulsions have been formed with two or more immiscible liquids. A particularly useful emulsion is comprised of a water based liquid and a liquified normally gaseous fluid such as carbon dioxide. Upon pressure release, the liquified gaseous fluid vaporizes and rapidly flows out of the formation.

The most common carrier liquid/fracturing fluid utilized heretofore which is also preferred for use in accordance with this invention is comprised of an aqueous liquid such as fresh water or salt water combined with a gelling agent for increasing the viscosity of the liquid. The increased viscosity reduces fluid loss and allows the carrier liquid to transport significant concentrations of particulate material into the subterranean zone to be completed.

A variety of gelling agents have been utilized including hydratable polymers which contain one or more functional groups such as hydroxyl, cis-hydoxyl, carboxyl, sulfate, sulfonate, amino or amide. Particularly useful such polymers are polysaccharides and derivatives thereof which contain one or more of the monosaccharides units galactose, mannose, glucoside, glucose, xylose, arabinose, fructose, glucuronic acid or pyranosyl sulfate. Various natural hydratable polymers contain the foregoing functional groups and units including guar gum and derivatives thereof, cellulose and derivatives thereof, and the like. Hydratable synthetic polymers and co-polymers which contain the above mentioned functional groups can also be utilized including polyacrylate, polymeythlacrylate, polyacrylamide, and the like.

Particularly preferred hydratable polymers which yield high viscosities upon hydration at relatively low concentrations are guar gum and guar derivatives such as hydroxypropylguar and carboxymethylguar and cellulose derivatives such as hydroxyethylcellulose, carboxymethylcellulose and the like.

The viscosities of aqueous polymer solutions of the types described above can be increased by combining cross-linking agents with the polymer solutions. Examples of cross-linking agents which can be utilized are multivalent metal salts or compounds which are capable of releasing such metal ions in an aqueous solution.

The above described gelled or gelled and cross-linked carrier liquids/fracturing fluids can also include gel breakers such as those of the enzyme type, the oxidizing type or the acid buffer type which are well known to those skilled in the art. The gel breakers cause the viscous carrier liquids/fracturing fluids to revert to thin fluids that can be produced back to the surface after they have been utilized.

The creation of one or more fractures in the unconsolidated subterranean zone to be completed in order to stimulate the production of hydrocarbons therefrom is well known to those skilled in the art. The hydraulic fracturing process generally involves pumping a viscous liquid containing suspended particulate material into the formation or zone at a rate and pressure whereby fractures are created therein. The continued pumping of the fracturing fluid extends the fractures in the zone and carries the particulate material into the fractures. Upon the reduction of the flow of the fracturing fluid and the reduction of pressure exerted on the zone, the particulate material is deposited in the fractures and the fractures are prevented from closing by the presence of the particulate material therein.

As mentioned, the subterranean zone to be completed can be fractured prior to or during the injection of the particulate material into the zone, i.e., the pumping of the carrier liquid containing the particulate material through the slotted liner into the zone. Upon the creation of one or more fractures, the particulate material can be pumped into the fractures as well as into the perforations and into the annuli between the sand screen and slotted liner and between the slotted liner and the well bore. If desired, the particulate may be consolidated utilizing substantially any of the conventionally known hardenable resin compositions.

In order to further illustrate the methods of this invention, the following example is given.

EXAMPLE I

Flow tests were performed to verify the uniform packing of particulate material in the annulus between a simulated well bore and a slotted liner. The test apparatus was comprised of a 5' long by 2" diameter plastic tubing for simulating a well bore. Ten equally spaced ⅝" diameter holes were drilled in the tubing along the length thereof to simulate perforations in a well bore. A screen was placed inside the tubing over the ⅝" holes in order to retain sand introduced into the tubing therein. No back pressure was held on the tubing so as to simulate an unconsolidated high permeability formation.

A section of ⅝" ID plastic tubing was perforated with multiple holes of ⅜" to ½" diameters to simulate a slotted liner. The ⅝" tubing was placed inside the 2" tubing without centralization. Flow tests were performed with the apparatus in both the vertical and horizontal positions.

In one flow test, an 8 pounds per gallon slurry of 20/40 mesh sand was pumped into the ⅝" tubing. The carrier liquid utilized was a viscous aqueous solution of hydrated hydroxypropylguar (at a 60 pound per 1000 gallon concentration). The sand slurry was pumped into the test apparatus with a positive displacement pump. Despite the formation of sand bridges at the high leak off areas (at the perforations), alternate paths were provided through the slotted tubing to provide a complete sand pack in the annulus.

In another flow test, a slurry containing two pounds per gallon of 20/40 mesh sand was pumped into the ⅝" tubing. The carrier liquid utilized was a viscous aqueous solution of hydrated hydroxypropylguar (at a concentration of 30 pounds per 1000 gallon). Sand bridges were formed at each perforation, but the slurry was still able to transport sand into the annulus and a complete sand pack was produced therein.

In another flow test, a slurry containing two pounds per gallon of 20/40 mesh sand was pumped into the test apparatus. The carrier liquid was a viscous aqueous solution of hydrated hydroxypropylguar (at a 45 pound per 1000 gallon concentration). In spite of sand bridges being formed at the perforations, a complete sand pack was produced in the annulus.

EXAMPLE II

Large-scale flow tests were performed using a fixture which included an acrylic casing for ease of observation of proppant transport. The acrylic casing had a 5.25" ID and a total length of 25 ft. An 18-ft. length, 4.0" ID, acrylic slotted liner with ¾" holes at a spacing of 12 holes per foot was installed inside the casing. An 8-gauge wire-wrapped sand screen was installed inside the acrylic slotted liner. The sand screen had an O.D. of 2.75 inches and a length of 10 ft. An 18-inch segment of pipe was extended from the screen at each end. A ball valve was used to control the leakoff through the screen. However, it was fully opened during the large scale flow tests.

Two high leakoff zones in the casing were simulated by multiple 1" perforations formed therein. One zone was located close to the outlet. The other zone was located about 12 ft. from the outlet. Each perforation was covered with 60 mesh screen to retain proppant during proppant placement. Ball valves were connected to the perforations to control the fluid loss from each perforation. During the flow tests the ball valves were fully opened to allow maximum leakoff.

Two flow tests were performed to determine the packing performance of the fixture. Due to the strength of the acrylic casing, the pumping pressure could not exceed 100 psi.

Figure 8:
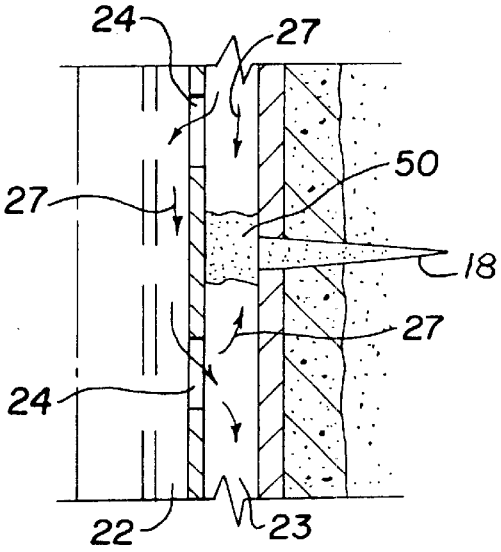
FIG. 8 is a side cross-sectional view of the well bore of FIG. 1 view only the portion of the cross-sectional on one side of the centerline.
Figure 9:
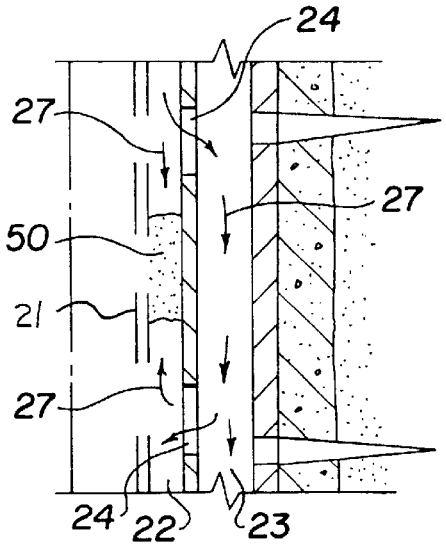
FIG. 9 is a side cross-sectional view of the well bore of FIG. 1 viewing only the portion of the cross-sectional on one side of the centerline.

In the first test, an aqueous hydroxypropyl guar linear gel having a concentration of 30 pounds per 1000 gallons was used as the carrier fluid. A gravel slurry of 20/40 mesh sand having a concentration of 2 pounds per gallon was prepared and pumped into the fixture at a pump rate of about ½ barrel per minute. Sand quickly packed around the wire-wrapped screen 21 (see, e.g. FIG. 9) and packed off the high leakoff areas of the perforations 18 (see, e.g. FIG. 8) whereby sand bridges 50 were formed. However, the sand slurry 27 flowed through the slots 24 and open bottom of the slotted liner 20, bypassed the bridged areas 50 and completely filled the voids resulting in a complete sand pack throughout the annuli between the sand screen and the slotted liner and between the slotted liner and the casing. The exemplary flow of slurry 27 bypassing bridges 50 using slots 24 to the leave and return to the bridged annulus is illustrated in FIG. 8 (bypassing a bridge 50 in annulus 23 at a perforation 18) and FIG. 9 (bypassing a bridge 50 in annulus 22 at wire-wrapped screen 21).

In the second test, a 45 pound per 1000 gallon aqueous hydroxypropyl guar gel was used as the carrier fluid and the sand concentration was 6 pounds per gallon of gel. The pump rate utilized was about ½ barrel per minute. The same type of complete sand pack was formed and observed in this test.

Thus, the present invention is well adapted to carry out the objects and attain the ends and advantages mentioned as well as those which are inherent therein. While numerous changes may be made by those skilled in the art, such changes are included in the spirit of this invention as defined by the appended claims.

What is claimed is:

1. A method of completing an unconsolidated subterranean zone penetrated by a wellbore having an upper end and a lower end comprising:

placing in the lower end of the wellbore in the zone a liner having slots therein whereby a first annulus is formed between the liner and the wellbore;

placing in the lower end of the well bore in the zone a screen within the liner whereby a second annulus is formed between the screen and the liner;

packing the first annulus with particulate material deposited out of a slurry containing the particulate material flowed into the first annulus;

bypassing a sand bridge formed in the first annulus, wherein one side of the sand bridge blocks at least a portion of the flow in the first annulus, by using the second annulus as an alternate path for the slurry whereby flow from the alternate path enters the first annulus on the other side of the blocking sand bridge by way of at least one of the slots in the liner.

2. The method of claim 1, wherein the action of bypassing a sand bridge by using the second annulus as an alternate path for the slurry further comprises the flow entering and exiting the alternate path by way of the slots in the liner.

3. The method of claim 1 further comprising the action of removing at least a portion of fluid from the flow of slurry in the alternate path by way of the screen while leaving particulate material in the alternate path.

4. The method of claim 1, wherein the actions of placing the liner in the lower end of the wellbore and of placing the screen within the liner in the lower end of the wellbore occur at the same time.

5. The method of claim 4 wherein the liner is coupled to the screen.

6. The method of claim 1, wherein the action of packing the first annulus with particulate material deposited out of a slurry containing the particulate material flowed into the first annulus further comprises packing the second annulus with particulate material deposited out of a slurry containing the particulate material flowed into the second annulus.

7. The method of claim 1, further comprising, prior to the action of packing the first annulus, installing a packer between the liner and the upper end of the wellbore.

8. The method of claim 1, wherein the slots have an area of at least the area of a circle having a diameter of ½ inch.

9. The method of claim 8, wherein the slots are circular having a diameter of at least ½ inch.

10. The method of claim 1, wherein the slots have an area of at least the area of a rectangle having a width of ⅜ inch and a length of 2 inches.

11. The method of claim 10, wherein the slots are rectangular having a width of at least ⅜ inch and a length of at least 2 inches.

12. The method of claim 1, wherein the particulate material comprises graded sand having a particle size in the range from about 10 to about 70 mesh.

13. The method of claim 12, wherein the particulate material consists essentially of graded sand having a particle size in the range from about 10 to about 70 mesh.

14. A method of completing an unconsolidated subterranean zone penetrated by a wellbore having an upper end and a lower end comprising:

placing in the lower end of the wellbore in the zone a liner having slots therein whereby a first annulus is formed between the liner and the wellbore;

placing in the lower end of the well bore in the zone a screen within the liner whereby a second annulus is formed between the screen and the liner;

packing the first annulus with particulate material deposited out of a slurry containing the particulate material flowed into the first annulus;

bypassing a sand bridge formed in the second annulus, wherein one side of the sand bridge blocks at least a portion of the flow in the second annulus, by using the first annulus as an alternate path for the slurry whereby flow from the alternate path enters the second annulus on the other side of the blocking sand bridge by way of at least one of the slots in the liner.

15. The method of claim 14, wherein the action of bypassing a sand bridge by using the first annulus as an alternate path for the slurry further comprises the flow entering and exiting the alternate path by way of the slots in the liner.

16. The method of claim 14 wherein the actions of placing the liner in the lower end of the wellbore and of placing the screen within the liner in the lower end of the wellbore occur at the same time.

17. The method of claim 16 wherein the liner is coupled to the screen.

18. The method of claim 14, wherein the action of packing the first annulus with particulate material deposited out of a slurry containing the particulate material flowed into the first annulus further comprises packing the second annulus with particulate material deposited out of a slurry containing the particulate material flowed into the second annulus.

19. The method of claim 14 further comprising, prior to the action of packing the first annulus, installing a packer between the liner and the upper end of the wellbore.

20. The method of claim 14, wherein the slots have an area of at least the area of a circle having a diameter of ½ inch.

21. The method of claim 20, wherein the slots are circular having a diameter of at least ½ inch.

22. The method of claim 14, wherein the slots have an area of at least the area of a rectangle having a width of ⅜ inch and a length of 2 inches.

23. The method of claim 22, wherein the slots are rectangular having a width of at least ⅜ inch and a length of at least 2 inches.

24. The method of claim 14, wherein the particulate material comprises graded sand having a particle size in the range from about 10 to about 70 mesh.

25. The method of claim 24, wherein the particulate material consists essentially of graded sand having a particle size in the range from about 10 to about 70 mesh.

26. A method of completing an unconsolidated subterranean zone penetrated by a wellbore having an upper end and a lower end comprising:

placing in the lower end of the wellbore in the zone a liner having slots therein whereby an outer annulus is formed between the liner and the wellbore;

placing in the lower end of the well bore in the zone a screen within the liner whereby a medial annulus is formed between the screen and the liner;

pumping a slurry containing particulate material into a first annulus between the screen and the wellbore whereby the slurry bypasses a sand bridge formed in the first annulus by flowing through at least one of the slots in the liner into a second annulus and then flowing through at least one other of the slots and back into the first annulus on the other side of the sand bridge.

27. The method of claim 26 wherein the outer annulus is the first annulus and wherein the medial annulus is the second annulus.

28. The method of claim 27 further comprising the action of removing at least a portion of fluid from the flow of slurry in the second annulus by way of the screen while leaving particulate material in the second annulus.

29. The method of claim 26 wherein the medial annulus is the first annulus and wherein the outer annulus is the second annulus.

30. The method of claim 29 further comprising the action of removing at least a portion of fluid from the flow of slurry in the first annulus by way of the screen while leaving particulate material in the first annulus.

31. The method of claim 26 wherein the action of pumping a slurry into a first annulus further comprises pumping a slurry through a crossover into the first annulus.

32. The method of claim 26 wherein the action of pumping a slurry into a first annulus further comprises:

pumping a slurry containing particulate material into a first annulus between the screen and the wellbore and into a second annulus between the screen and the wellbore, whereby the slurry bypasses a sand bridge formed in one of the first and second annulus by flowing through at least one of the slots in the liner into the other of the first and second annulus and then flowing through at least one other of the slots and back into the one of the first and second annulus on the other side of the sand bridge.

33. The method of claim 32 wherein the action of pumping a slurry into a first annulus comprises:

pumping a slurry containing particulate material into the outer annulus and into the medial annulus, whereby the slurry bypasses a sand bridge formed in one of the outer and medial annulus by flowing through at least one of the slots in the liner into the other of the outer and medial annulus and then flowing through at least one other of the slots and back into the one of the outer and medial annulus on the other side of the sand bridge.

34. The method of claim 33 wherein the action of pumping a slurry into the outer annulus and into the medial annulus further comprises pumping a slurry through a crossover into the outer annulus and into the medial annulus.

35. The method of claim 33 further comprising the action of removing at least a portion of fluid from the flow of slurry in the medial annulus by way of the screen while leaving particulate material in the medial annulus.

36. The method of claim 26 wherein the actions of placing the liner in the lower end of the wellbore and of placing the screen within the liner in the lower end of the wellbore occur at the same time.

37. The method of claim 36 wherein the liner is coupled to the screen.

38. The method of claim 26, wherein the action of pumping slurry into the first annulus results in packing the outer annulus with particulate material deposited out of the slurry.

39. The method of claim 26, wherein the action of pumping slurry into the first annulus results in packing the medial annulus with particulate material deposited out of the slurry.

40. The method of claim 26, wherein the action of pumping slurry into the first annulus results in packing both the outer annulus and the medial annulus with particulate material deposited out of the slurry.

41. The method of claim 26, further comprising, prior to the action of pumping the slurry, installing a packer between the liner and the upper end of the wellbore.

42. The method of claim 26, wherein the slots have an area of at least the area of a circle having a diameter of ½ inch.

43. The method of claim 42, wherein the slots are circular having a diameter of at least ½ inch.

44. The method of claim 26, wherein the slots have an area of at least the area of a rectangle having a width of ⅜ inch and a length of 2 inches.

45. The method of claim 44, wherein the slots are rectangular having a width of at least ⅜ inch and a length of at least 2 inches.

46. The method of claim 26, wherein the particulate material comprises graded sand having a particle size in the range from about 10 to about 70 mesh.

47. The method of claim 46, wherein the particulate material consists essentially of graded sand having a particle size in the range from about 10 to about 70 mesh.

* * * * *